US006440015B1

(12) United States Patent
Chang

(10) Patent No.: US 6,440,015 B1
(45) Date of Patent: Aug. 27, 2002

(54) STRING FASTENER FOR A RACKET

(76) Inventor: Chen-Chung Chang, No. 912, Chung Shang Rd., Shen Kang, Taichung Hsien, 429 (TW)

( * ) Notice: Subject to any disclaimer, the term of this patent is extended or adjusted under 35 U.S.C. 154(b) by 0 days.

(21) Appl. No.: 09/930,300

(22) Filed: Aug. 16, 2001

(51) Int. Cl.[7] ..... A63B 49/00
(52) U.S. Cl. ..... 473/540; 473/539
(58) Field of Search ..... 493/539, 540, 493/543, 534

(56) References Cited

U.S. PATENT DOCUMENTS 4,681,319 A * 7/1987 Zilinskas ..... 273/DIG. 23
5,762,570 A * 6/1998 Shaw ..... 473/522
6,319,160 B1 * 11/2001 Hsu ..... 473/540
6,336,877 B1 * 1/2002 Arroyo et al. ..... 473/521

FOREIGN PATENT DOCUMENTS

GB 2196537 * 5/1988 ..... 473/FOR 178

* cited by examiner

*Primary Examiner*—Raleigh W. Chiu
(74) *Attorney, Agent, or Firm*—Troxell Law Offices PLLC

(57) ABSTRACT

A string fastener for a racket includes an annular U-shaped wall, a plurality of tubes spaced apart equidistantly on inner side of the U-shaped wall, and each tube has a string hole inserted therethrough and in a racket frame. The U-shaped wall is formed integral with the string fastener and the same number of string support members as the tubes are formed integral between the two vertical inner surfaces of the U-shaped wall for the strings to rest thereon after the strings are inserted through the tubes. Thus, the strings on the string support members are protected from cut off and the friction coefficient of the strings is greatly reduced.

6 Claims, 6 Drawing Sheets

STRING FASTENER FOR A RACKET

BACKGROUND OF THE INVENTION

This invention relates to a string fastener for a racket, particularly to one possible to protect the strings of the racket from cut off with their friction against a racket frame lessened.

A known conventional string fastener, as shown in FIG. 7, includes a racket frame 1 having a string fastener 2 closely fixed on its outer side. The string fastener 2 is provided with a plurality of short tubes 4 spaced apart around its inner wall and inserted in the racket frame 1, with each tube 4 having a string hole 3 for a string to pass through. The string fastener 2 with the tubes 4 is formed integral by means of injection molding, and these tubes 4 are inserted in holes bored in the racket frame 1, and then strings 5 are orderly inserted through these tubes 4 to be protected inside.

However, referring to FIG. 6, in the known conventional racket mentioned above, the strings 5 are made to pass through each tube 4 first and then bent tightly in a right angle and pass through another tube 4 and so on, with the strings 5 compressing every two adjacent tubes and pushing against their inner walls. Additionally, every hole of the racket frame 1 is formed into an acute-angled edge 6, and after a string 5 is inserted through a tube 4, it is bent tightly in a right angle to rest against the aforesaid acute-angled edge 6 of each hole and then passes through another tube 4 along the bottom of the string fastener 2.

Thus, when the strings 5 are netted on a racket, the acute-angled edges 6 of the holes are liable to render the tube 4 broken by excessive force and even cut off the strings 5.

Further, when a string 5 is inserted through the tube 4, it leans closely on its inner wall A and then is bent in a right angle to rest against the aforesaid acute-angled edge 6 of each hole of the racket frame 1 and subsequently is pulled along the bottom of the string fastener 2 and passes through another tube 4 to push against its inner wall A. Under such condition, the contact area between each string 5 and the string fastener 2 is large and the friction of the string 5 on this contact area increases so that the string 5 is likely to be cut off by aforesaid friction.

SUMMARY OF THE INVENTION

The main objective of this invention is to offer a string fastener for a racket, possible to protect the strings of a racket from cut off and reduce the friction coefficient of the strings.

The feature of the invention is the string fastener having a plurality of tubes provided spaced apart equidistantly on its inner wall, with each tube having a string hole for a string to pass through and inserted in the racket frame. The string fastener has a U-shaped wall formed integral on upper portion, and the same number of string support members as the tubes are formed integral between two vertical inner surfaces of the U-shaped wall, with each support member for each string of a racket to rest thereon after inserted through the tubes .

Another objective is to offer a string fastener, which needs only to modify its structure, but with the structure of a racket frame unchanged.

BRIEF DESCRIPTION OF DRAWINGS

This invention will be better understood by referring to the accompanying drawings wherein.

DETAILED DESCRIPTION OF THE PREFERRED ENBODIMENT

Figure 1:
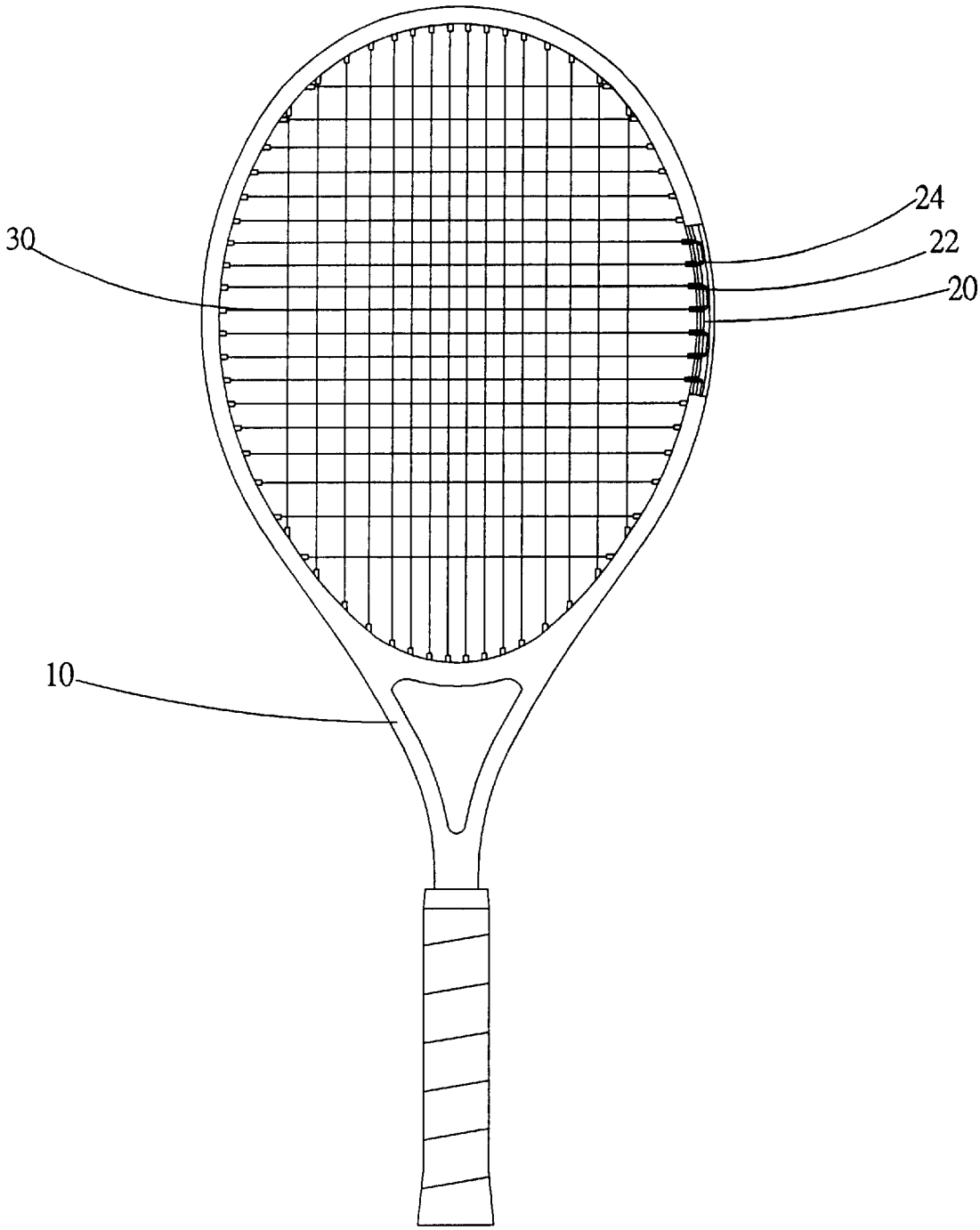
FIG. 1 is a front view of a racket with a string faster in the present invention.
Figure 2:
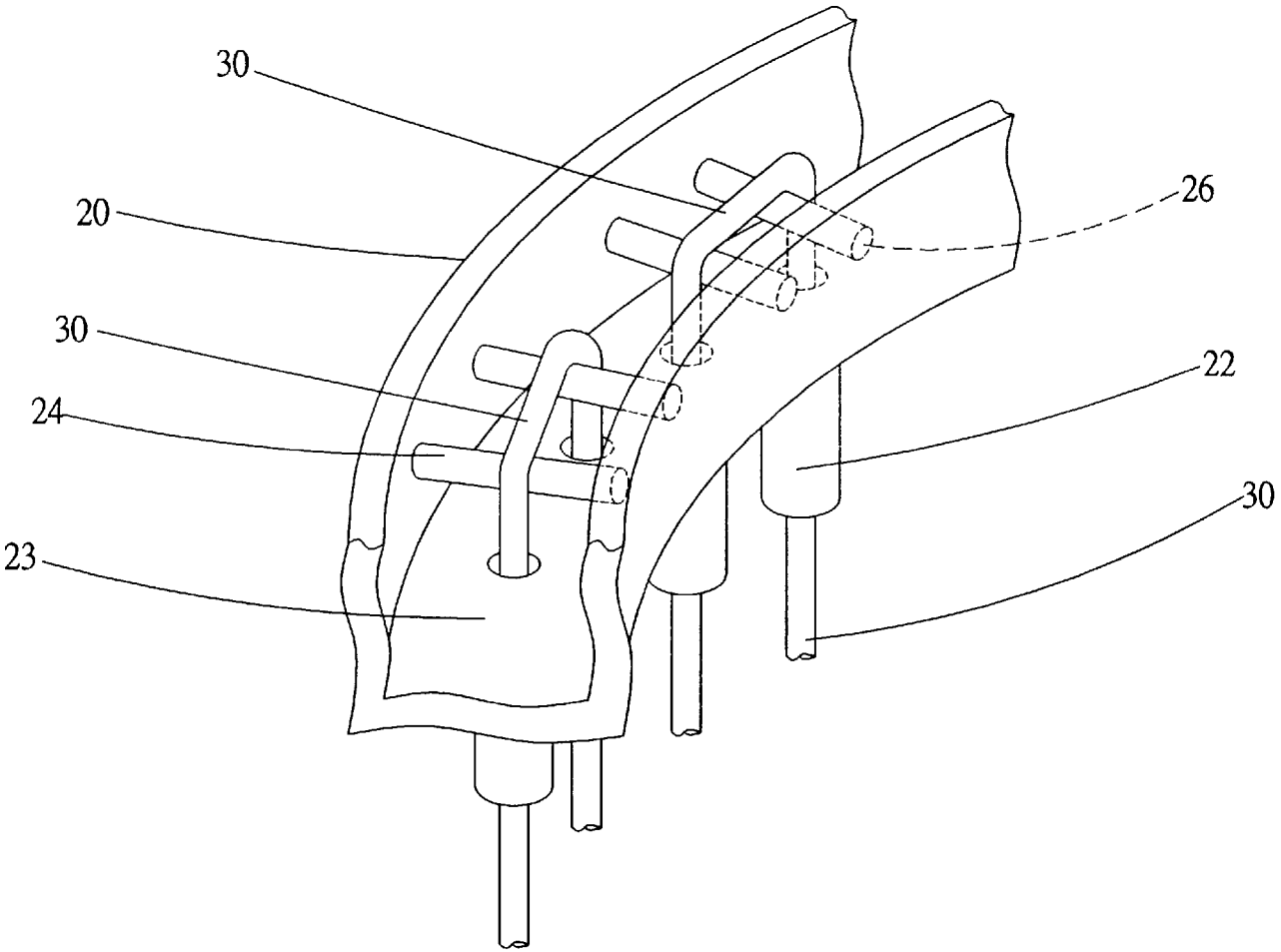
FIG. 2 is a partial perspective view of a string fastener in the present invention.

A preferred embodiment of a string fastener for a racket in the present invention, as shown in FIGS. 1 and 2, has an annular string fastener 20, a plurality tubes 22 formed spaced apart equidistantly on inner wall of the annular string fastener 20 and respectively having a string hole 21 and inserted in the racket frame 10 surrounding the string fastener 20.

A critical improved feature of the string fastener 20 is a U-shaped wall 23 formed integral in an upper portion of the string fastener 20 and the same number of string support members 24 as the tubes 22 formed integral between two inner surfaces of the U-shaped wall 23 and just located above the tubes 22. Each string support member 24 is column-shaped for a string 30 to rest on after the string 30 is inserted through each tube 22.

Figure 3:
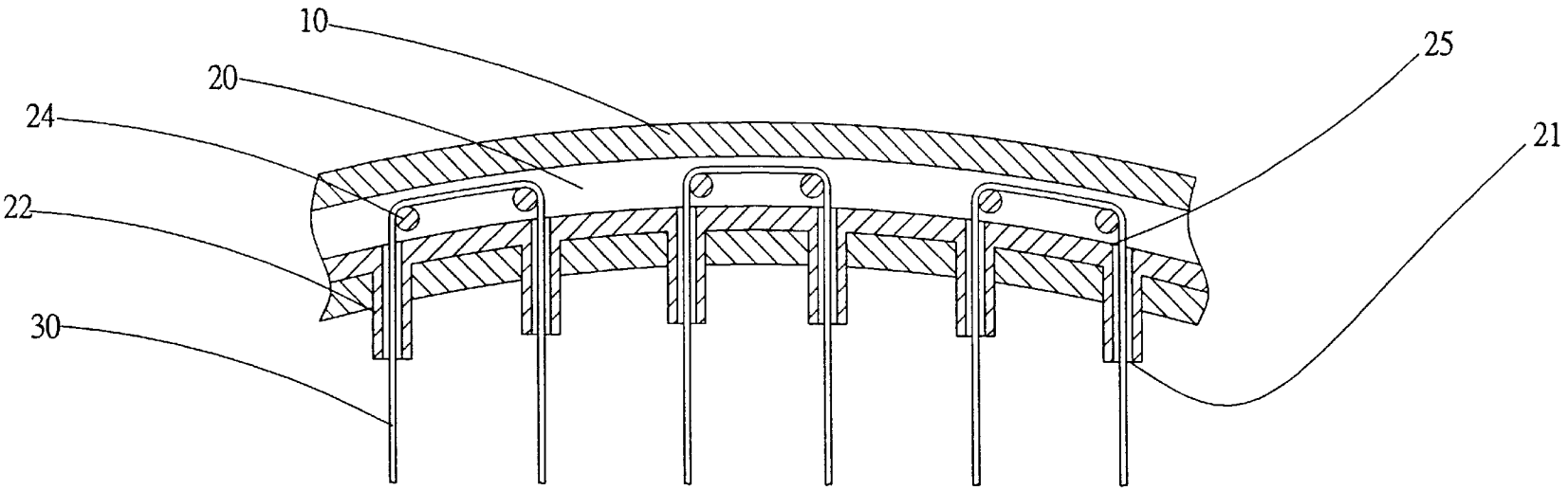
FIG. 3 is a side cross-sectional view of the string fastener in the present invention.
Figure 5:
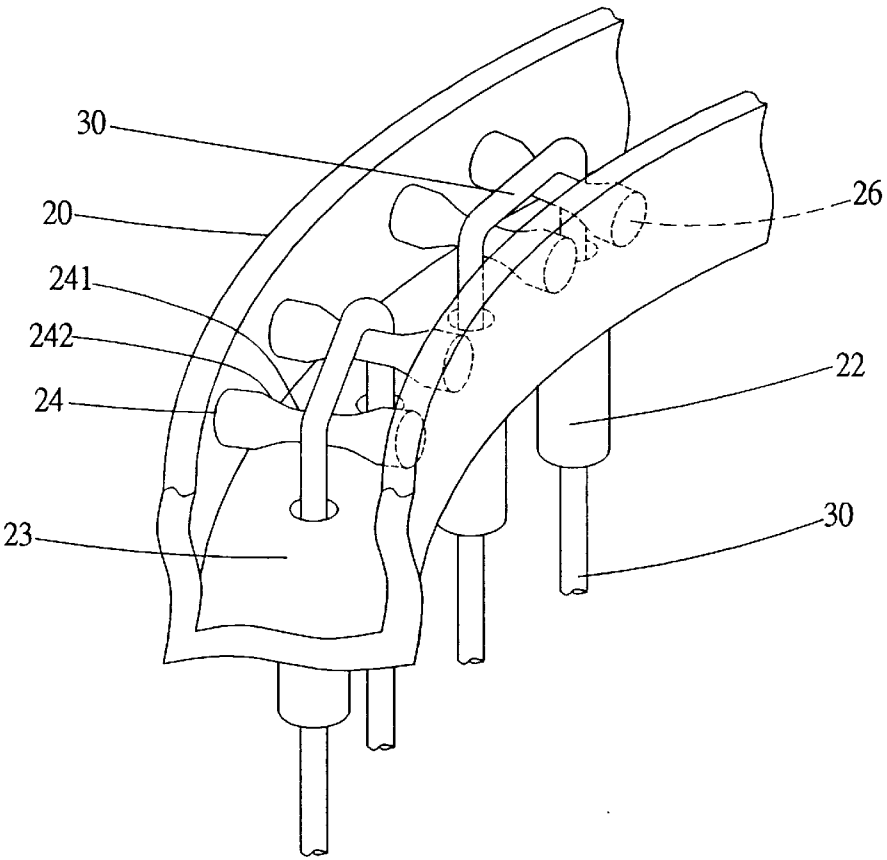
FIG. 5 is a partial perspective view of the string fastener with the string support members of the second embodiment in the present invention.

Specifically, referring to FIG. 3, the string fastener 20 is formed integral with the U-shaped wall 23, the tubes 22 and the string support members 24 by means of injection molding. After a string is inserted through a tube 22, it will be bent to rest on the string support member 24 not contacting with the inner wall of the tube 22 because the diameter of the tube 22 is larger than that of the string 30, thus preventing the tube 22 from broken and from cutting off a string 30 by no acute-angled edge 25 provided in a hole of the conventional string fastener and consequently increasing the resilience of the strings of a racket.

Besides, each string 30 is bent in an arc-shaped angle to rest on each support member 24, thus lessening the friction area between a string 30 and the racket frame 10 and lowering at least eighty percent of the friction coefficient of the string 30. Further, the string support members 24 and the string fastener 20 are formed integral, easy in manufacturing and assembling, needless to modify the structure of an original racket frame 10, lowering its cost.

Figure 4:
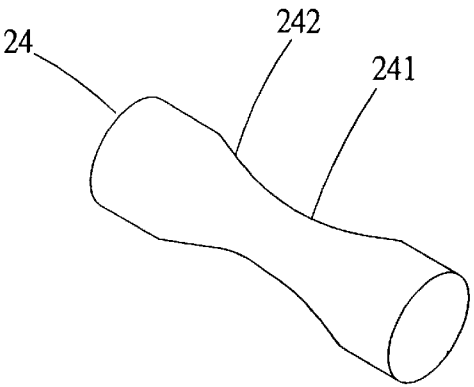
FIG. 4 is a perspective view of a second embodiment of a string support member in the present invention.
Figure 6:
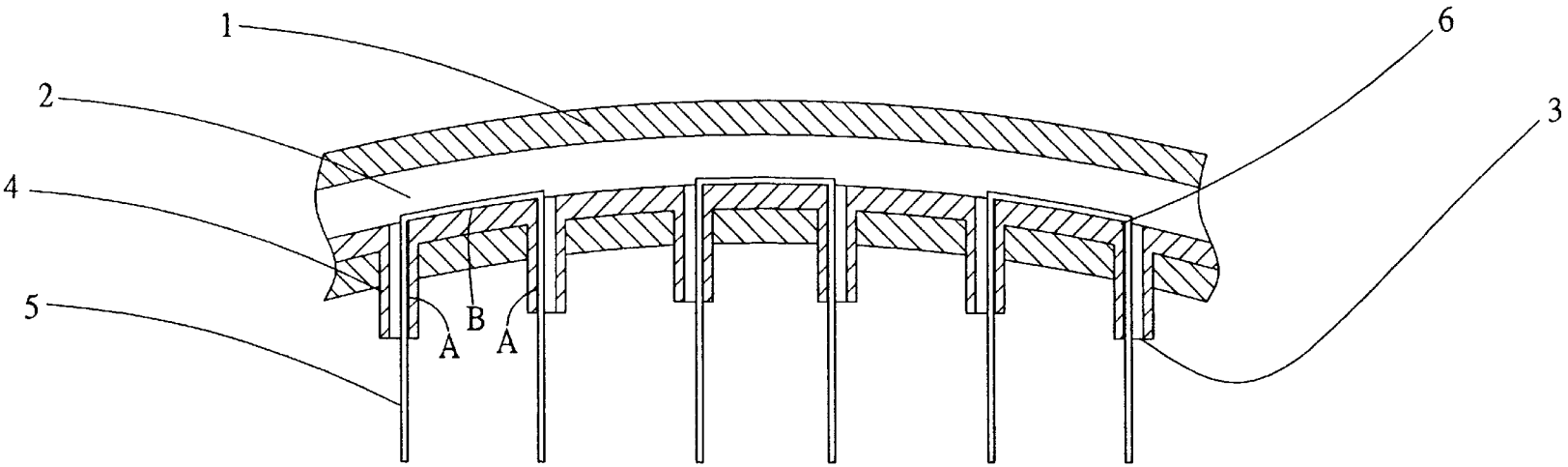
FIG.6 PRIOR ART
FIG. 6 is a partial cross-sectional view of a conventional racket.
Figure 7:
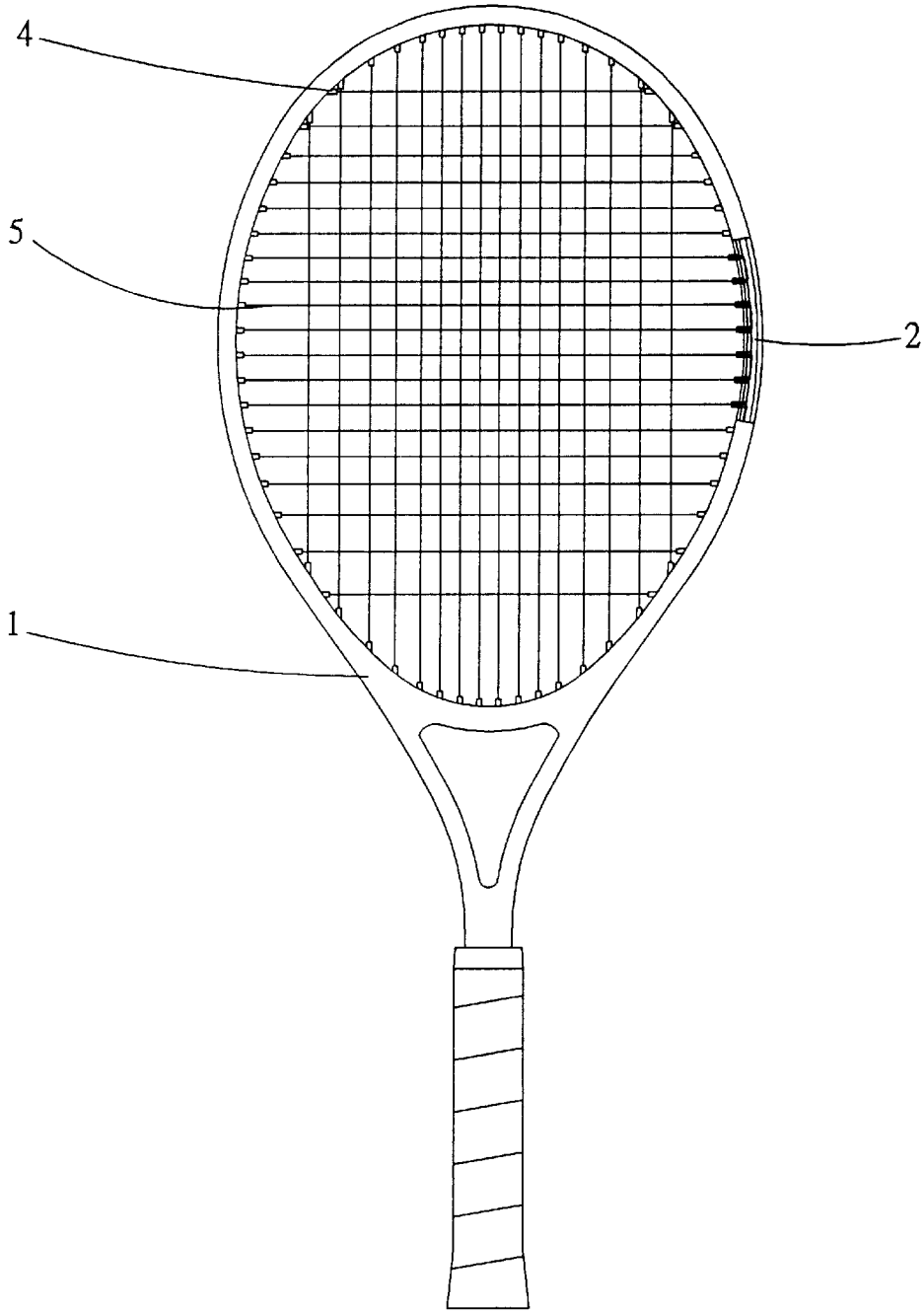
FIG.7 PRIOR ART
FIG. 7 is a front view of the conventional racket.

Another preferred embodiment of a string support member 24 of the string fastener 20 in the present invention, as shown in FIG. 4, respectively have an annular curved recess 241 formed in the center portion with two opposite sides expanding to form two conical surfaces 242. The string support members 24 are made of plastic and formed integral with the spring fastener 20. The string 30 is inserted through the short tube 22, and bent to rest on the curved recess 241 of each string support member 24, positioned stably thereon.

In addition, the U-shaped wall 23 of the above-mentioned racket frame 10 can be bored with a plurality of insert holes 26 in predetermined positions for stably receiving the string support members 24 therein and these string support members 24 can be made either of metal or of plastic.

While the preferred embodiments of the invention have been described above, it will be recognized and understood that various modifications may be made therein and the appended claims are intended to cover all such modifications that may fall within the spirit and scope of the invention.

I claim:

1. A string fastener for a racket comprising an annular U-shaped wall, a plurality of short tubes spaced apart equidistantly on an inner side of said U-shaped wall, said tubes respectively having a string hole and inserted in a racket frame: and, Characterized by said U-shaped wall formed integral on an upper portion of said string fastener, the same number of string support members as said tubes formed integral between two vertical inner surfaces of said U-shaped wall and above each said short tube, each said string resting on each said string support member and then inserted through each said tubes.

2. The string fastener for a racket as claimed in claim 1, wherein said string support members are column-shaped.

3. The string fastener for a racket as claimed in claim 1, wherein each said string support member has an annular curved recess around its center portion and two opposite sides of said recess are formed in expanding-out conical surfaces.

4. The string fastener for a racket as claimed in claim 1, wherein said string support members are made of plastic.

5. The string fastener for a racket as claimed in claim 1, wherein said U-shaped wall is provided with insert holes in preset locations for stably receiving said string support members therein.

6. The string fastener for a racket as claimed in claim 5, wherein said string support members are made of metal.

* * * * *